United States Patent [19]

Nickola

[11] 4,248,908

[45] Feb. 3, 1981

[54] HOT-DIP METALLIC COATINGS ON LOW CARBON ALLOY STEEL

[75] Inventor: Richard A. Nickola, Highland, Ind.

[73] Assignee: Inland Steel Company, Chicago, Ill.

[21] Appl. No.: 55,330

[22] Filed: Jul. 6, 1979

[51] Int. Cl.[3] ..... C23C 1/08

[52] U.S. Cl. ..... 427/156; 427/320; 427/321; 427/329

[58] Field of Search ..... 427/156, 311, 320, 321; 106/14.15, 14.18, 14.24, 14.31; 148/23, 25

[56] References Cited

U.S. PATENT DOCUMENTS

| | | | |
|---|---|---|---|
| 3,015,580 | 1/1962 | Zisman et al. | 106/14.31 |
| 3,540,907 | 11/1970 | Moore | 427/311 |
| 3,843,574 | 10/1974 | Apikos | 260/28.5 AV |
| 3,954,460 | 5/1976 | Nickola | 75/208 CS |
| 4,130,524 | 12/1978 | Boerwinkle et al. | 260/29.6 HN |
| 4,131,583 | 12/1978 | Boerwinkle | 260/29.6 HN |

*Primary Examiner*—Ralph S. Kendall

*Attorney, Agent, or Firm*—Merriam, Marshall & Bicknell

[57] ABSTRACT

A process of hot-dip coating a strip of cold rolled low carbon steel having as an essential alloying element at least one strong oxide forming metal, such as titanium, aluminum, silicon or chromium or a combination thereof, to overcome the difficulty of uniformly hot-dip coating such steels with aluminum and other protective metals on a Sendzimir-type hot-dip coating line wherein the steel strip is thoroughly cleaned by washing in an alkaline cleaning solution, brushing and drying to remove metallic particles and non-metallic contaminants, forming a dry film coating on a clean dry surface of the strip of a higher fatty acid amide having from 8 to 18 carbon atoms, heating said strip to a temperature sufficient to completely volatilize said amide film coating, passing said strip through a heating zone containing a reducing atmosphere in which the strip is heated to a temperature of at least about 704° C. (1300° F.), cooling said strip in a reducing atmosphere to about the temperature of a molten aluminum hot-dip coating bath, and passing said strip through said hot-dip coating bath. The amide coated steel strip has excellent corrosion resistance when stored in coiled form and is adapted for uniform hot-dip coating with aluminum on a Sendzimir-type hot-dip coating line.

9 Claims, 1 Drawing Figure

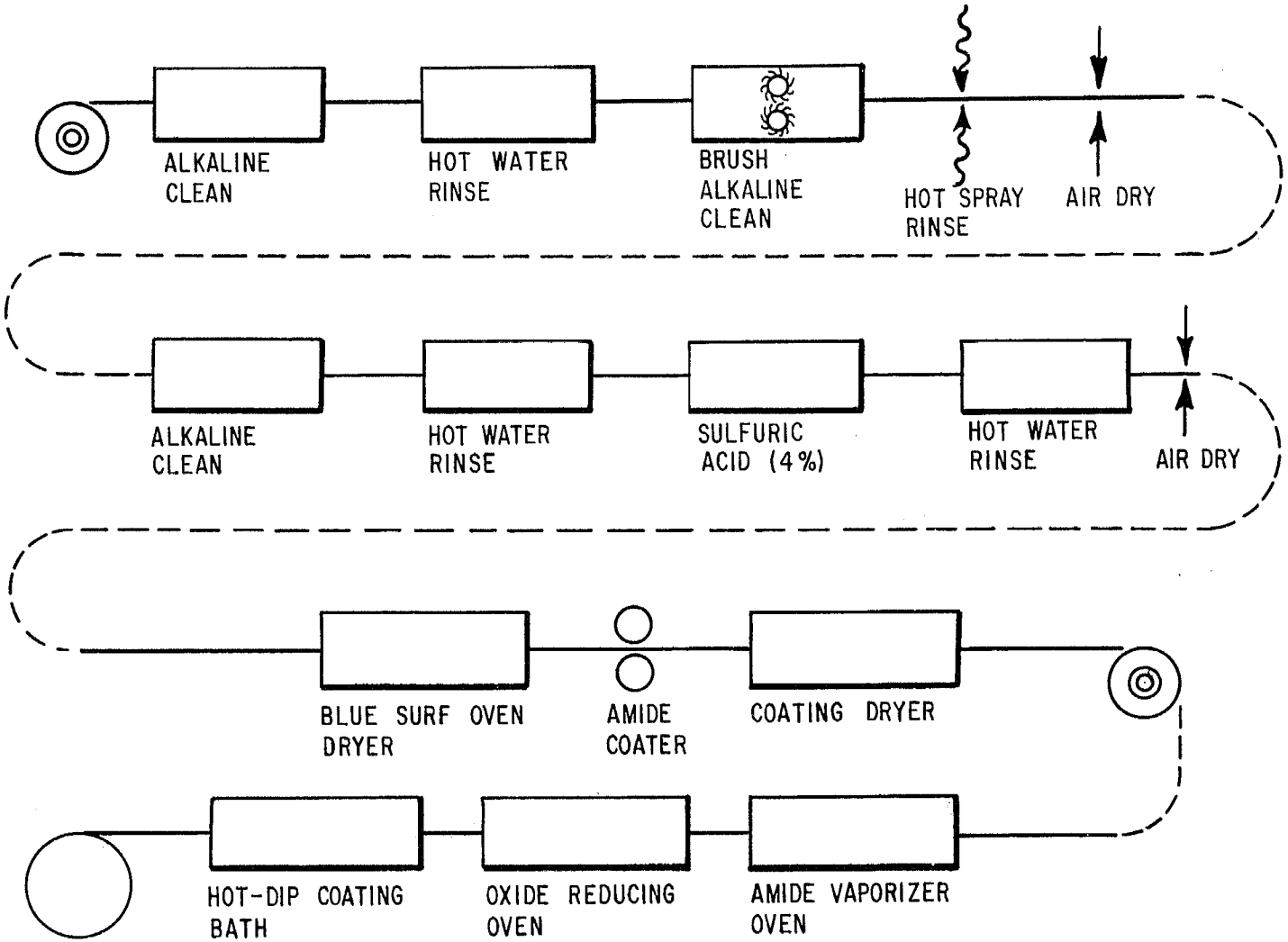
ALKALINE CLEAN
HOT WATER RINSE
BRUSH ALKALINE CLEAN
HOT SPRAY RINSE
AIR DRY
ALKALINE CLEAN
HOT WATER RINSE
SULFURIC ACID (4%)
HOT WATER RINSE
AIR DRY
BLUE SURF OVEN DRYER
AMIDE COATER
COATING DRYER
HOT-DIP COATING BATH
OXIDE REDUCING OVEN
AMIDE VAPORIZER OVEN

HOT-DIP METALLIC COATINGS ON LOW CARBON ALLOY STEEL

The present invention relates generally to a continuous process of applying a continuous hot-dip coating of a protective metal to a surface of a low carbon alloy steel strip which has as the essential alloying elements therein a strong oxide former, such as titanium, and more particularly to a process of applying a continuous hot-dip aluminum coating to a low alloy low carbon steel by a Sendzimir-type continuous hot-dip coating process wherein the alloying elements in said low carbon steel are strong oxide forming elements which make the surface of the steel difficult to wet when immersed in a molten aluminum coating bath.

Heretofore, it has been found that certain alloy low carbon steel strips when hot-dip coated with aluminum exhibit outstanding resistance to oxidation when exposed to elevated temperatures in an oxidizing atmosphere (see U.S. Pat. Nos. 3,881,880, 3,881,881 and 3,905,780). Each of the low carbon alloy steel strips disclosed in the foregoing patents contain less than about 5 percent added alloying elements selected from a group consisting of titanium, chromium, silicon and aluminum in addition to the usual elements present in a low carbon steel, such as a rimmed steel or aluminum killed steel, which are commonly used for hot-dip coating. While the aluminum coated product of the foregoing type can be produced more economically than the stainless steel products conventionally used where high temperature resistance to oxidation is required, it is difficult to provide a continuous hot-dip aluminum coating on these low alloy steels in a Sendzimir-type (U.S. Pat. No. 2,110,893) or similar hot-dip continuous coating process where the surface is oxidized to remove contaminants, because of the difficulty in uniformly wetting the surface of the alloy steel strip by the molten aluminum coating bath. When these low alloy steels are aluminum coated on a Sendzimir-type continuous coating line numerous uncoated spots result and the product fails to exhibit the desired high temperature oxidation resistance.

It is, therefore, an object of the present invention to provide an improved process of forming a uniform hot-dip coating on a steel strip by means of a Sendzimir-type continuous hot-dip coating line or similar hot-dip continuous coating line wherein the surface of the steel strip is oxidized to remove surface-contaminants and where the steel contains a strong oxide former as an alloying element, making the surface of the steel strip difficult to wet uniformly when continuously coated on a Sendzimir-type hot-dip coating line.

The FIGURE shows a preferred embodiment of the invention.

Other objects of the present invention will be apparent to one skilled in the art from the following detailed description and claims when read in conjunction with the accompanying drawing showing a schematic block diagram of a preferred embodiment of the process of the present invention.

In a Sendzimir-type continuous hot-dip coating process a cold rolled steel strip is heated to burn off non-metallic contaminants such as rolling oil and form a thin oxide film on the surface of the strip. Thereafter, the strip is passed through a heating furnace provided with a hydrogen-nitrogen reducing atmosphere at an elevated temperature to reduce the oxide film and form a metallic iron surface which is readily wetted by a molten metal hot-dip coating bath. When a cold rolled steel strip contains a strong oxide forming alloying element or combinations thereof, such as titanium, silicon, aluminum, and chromium, the steel strip is not completely wetted by a hot-dip coating bath, such as an aluminum coating bath, because the hydrogen reducing atmosphere used in the Sendzimir-type continuous hot-dip coating process is not able to reduce to a metallic state all of the strong oxide compounds or particles formed by the alloying element or elements in and on the surface of the strip.

It has been discovered that a low carbon steel sheet, such as rimmed steel or aluminum killed steel, containing one or more alloying elements which are strong oxide formers, such as titanium, silicon, chromium and aluminum, can be provided with a continuous hot-dip coating on a Sendzimir-type continuous hot-dip coating line by subjecting the steel strip after cold rolling to the following preferred sequence of steps:

A. Removal of Metallic and Non-Metallic Surface Contaminants by:

(1) Hot alkaline cleaning followed by hot water spray rinsing;

(2) Brushing vigorously with hot water followed by hot water spray rinsing and drying;

(3) Hot alkaline cleaning followed by thorough hot water spray rinsing and complete drying;

(a) A hot aqueous acid washing followed by hot water spray rinsing and drying to completely remove all moisture from the strip where spray washing does not completely remove all alkaline cleaning solution.

B. Coating Strip With a Protective Organic Coating:

(1) Applying a continuous protective coating of a higher fatty acid amide to the surface of said strip.

C. Heat Treating Strip:

(1) Heating said strip to a peak metal temperature between about 204° C. (400° F.) and 644° C. (1200° F.) which completely volatilizes said amide coating;

(2) Passing said strip through a furnace having a hydrogen containing reducing atmosphere in which the strip is heated to a peak temperature of at least about 704° C. (1300° F.) or higher and obtaining the desired recrystallization properties of the steel.

D. Hot-Dip Metal Coating:

(1) Cooling said strip in a reducing atmosphere to the temperature of the hot-dip coating bath and passing said strip through a hot-dip coating bath, such as molten aluminum.

The above-described combination of steps prior to hot-dip coating the strip has the effect of removing from the strip not only the hydrocarbon contamination, such as the rolling oil applied during the cold rolling of the strip, but also removes very fine metallic particles formed during cold rolling which normally do not interfere with the hot-dip coating process but when the fine particles contain titanium or other strong oxide formers do prevent a continuous hot-dip coating being formed on the strip in a Sendzimir-type hot-dip coating process. Any titanium oxide or other strong oxide formed in and on the surface of the strip during conventional processing which are not reduced to the metallic state during the reducing step of a Sendzimir-type process prevents the strip being continuously uniformly wetted by a hot-dip coating bath. By applying a water insoluble protective coating consisting of higher fatty acid amides to the clean surface of the strip prior to passing the strip through the initial heating zone of a Sendzimir-type process which typically heats the strip to a temperature of about 1000° F. to burn off lubricants and like contaminants, the formation of surface oxides which are difficult to reduce in a Sendzimir-type line (i.e. oxides of titanium or other strong oxide forming elements) are prevented by the coating of higher fatty acid amide and resulting decomposition products which form a protective blanket for the short length of time the strip remains in this zone during which it is heated above the vaporization and decomposition temperature of the amide forming the coating.

The fatty acid amides serve two basic functions: (1) providing corrosion protection of the activated surface of the steel strip prior to coating; and (2) preventing oxidation of the surface of the strip while the strip is passed through the initial heating zone of a Sendzimir-type hot-dip coating line. The useful amides of the higher fatty acids can be saturated or unsaturated and can have a carbon chain length of between about 8 to 18 carbon atoms which are solid at room temperature and melt between about 66° C. (150° F.) and 130° C. (266° F.). These amides volatilize at a temperature between about 174° C. (345° F.) and 250° C. (482° F.) without leaving any residue which could interfere with the subsequent hot-dip coating.

The higher fatty acid amides preferably are applied as a very thin film having a single side dry film coating weight ranging between about 0.1 to 2.0 grams per square meter. The wet film thickness ranges between about 0.05 mil to about 1.0 mil. Heavier dry film weight coatings have been used (i.e. 0.90 mils) without interferring with the process, but coating weights above about 0.09 mils (2.0 g/m$^2$) do not provide any significantly improved results.

The higher fatty acid amide films can be applied by any suitable film coating procedure, such as roll coating, spray coating and immersion coating in a molten bath or in a solvent solution. In the preferred form, the amide film is formed by roll coating with a solvent solution of the amide. The solvents which are suitable for use include methanol, ethanol, isopropanol, n-butonal and butyl acetate. When the film of the higher fatty acid amide is applied by application of a solvent solution of the amide, the strip may require heating to remove the solvent. If the strip is to be coiled, care must be taken when heating the strip to avoid melting the amide coating, since coiling the strip while the coating is in a flowable condition is detrimental to the coating. Heating the amide coating to cause reflowing is not objectionable, however, if the coating is allowed to solidify before coiling. Usually, when the strip is heated to effect complete drying prior to application of the amide coating, the residual heat of the strip is sufficient to flash evaporate the bulk of the solvent before the strip enters the curing or drying oven. If required, a rubber squeegee or equivalent means can be used to control the wet amide coating thickness as the strip is withdrawn from the roll coating station.

The alkaline cleaning solutions used to thoroughly clean the surface can have any conventional composition of the type used in the industry to remove rolling oils from a cold rolled steel strip, and the alkaline cleaning bath is preferably heated to a temperature of between about 65°-80° C. (149° F.-176° F.). For brushing of the surface of the steel strip during the cleaning operation any conventional cleaning brush can be used, such as a Scotch-Brite brush, and the brushing can be carried out using either hot water or a hot alkaline solution preferably at a temperature of between about 65°-80° C. (149° F.-176° F.).

The alkaline cleaning solution must be completely removed and the strip dried before coating the strip with the higher fatty acid amide. Spray rinsing with hot water can be used to completely remove the alkaline solution. It is frequently desirable, when the spray rinsing apparatus is not completely effective, to wash the strip with a dilute acid bath, such as a 4% by volume sulfuric acid aqueous solution (10.6 grams per liter) at a temperature of between about 43° C. and 54° C. (110° F.-130° F.). When an acid rinse is used, care must also be taken to completely wash all acid solution from the surface of the strip before drying and coating with the higher fatty acid amide.

The steel base of the type generally used in the present invention, before incorporating the titanium, aluminum, silicon, chromium or like oxide forming element, is a low-carbon steel which has a carbon content not above about 0.25 weight percent maximum and preferably has from about 0.03 weight percent to about 0.1 weight percent carbon. The low-carbon steel generally used in the present invention before the addition of the alloying elements will contain from about 0.2 weight percent to about 1.0 weight percent manganese, a maximum of about 0.03 weight percent sulfur, a maximum of about 0.015 weight percent phosphorus, about 0.05 weight percent silicon, a maximum of about 0.100 weight percent aluminum, and the balance being iron with the usual amounts of impurities and residuals.

A typical low-carbon aluminum killed steel suitable for cold rolling into sheets and hot-dip aluminum coating and in which a strong oxide forming element is incorporated has the following approximate composition:

| | Percent by Weight |
|---|---|
| C | 0.03-0.05 |
| Mn | 0.25-0.50 |
| S | 0.030 |
| P | 0.02 |
| Si | 0.05 |
| Al | 0.030-0.090 |
| Fe | balance |

The resulting steel base after addition of the alloying elements remains unchanged except for the increased concentration of titanium, aluminum, silicon, chromium or other added strong oxide forming elements. Generally, these alloy steels do not contain more than about 5% added alloying elements and are classified as low alloy low carbon steels.

The following Table I shows the amount of alloying elements which when added to the above typical low-carbon steel form cold rolled strips which can be hot-dip aluminum coated in accordance with the herein described procedure but is not limited thereto:

TABLE I

| Amounts of Alloying Elements Added To Typical Low-Carbon Steel (wt.%) |
|---|
| 0.33 Ti |
| 0.45 Ti |
| 0.60 Al + 1.20 Si |
| 1.31 Al + 1.03 Si |
| 0.66 Al + 1.09 Si |
| 1.25 Al + 1.03 Si + 1.15 Cr |

TABLE I-continued

| Amounts of Alloying Elements Added To Typical Low-Carbon Steel (wt.%) |
|---|
| 0.90 Al + 0.80 Si + 0.41 Ti |
| 0.90 Al + 0.80 Si + 1.20 Cr + 0.45 Ti |
| 1.20 Al + 0.70 Si + 16.0 Mn + 0.80 Mo |
| 1.20 Al + 1.10 Si + 15.8 Mn + 0.90 Mo + 1.5 Cu |
| 2.00 Al + 15.0 Mn |
| 15.0 Mn |

SPECIFIC EXAMPLE

A cold rolled aluminum killed steel strip having a carbon content of 0.05 wt. % and containing 0.45 wt. % titanium, said strip having a thickness of about 2 mm. and a width of about 1050 mm. was continuously immersed in an alkaline cleaning bath while traveling at a line speed of about 0.60 meters per second. The alkaline cleaning bath contained 15 gms per liter (2 oz. per gal.) Parker 356 Cleaner and was heated to a temperature of between 60° C.–77° C. (150° F.–170° F.). The strip leaving the alkaline cleaning bath was passed between water spray nozzles which impinged thereon water at a temperature of between 60°–77° C. (150° F.–170° F.). The strip was then continuously brushed with a Scotch-Brite brush operating at 75% of full load capacity in a hot water bath having a temperature of 66° C.–77° C. (150° F.–170° F.) and dried with air knife forced air dryers. The strip was again passed through an alkaline cleaning bath of identical composition and temperature and thereafter water spray rinsed with water at a temperature of 16° C.–27° C. (60° F.–80° F.). The strip was then passed through a 4% by volume sulfuric acid bath at a temperature between 43° C.–54° C. (110° F.–130° F.). The strip leaving the acid bath was water rinsed with service water at a temperature between 16° C.–27° C. (60° F.–80° F.), dried with an air knife and passed through a gas fired heating oven having a temperature of about 160° C. (320° F.) to remove all moisture from the strip. Thereafter, the strip was roll coated with an isopropanol solution of a higher fatty acid amine comprised essentially of high purified 9-octadecanamide containing small amounts of hexadecanamide and 9–12 octadecadienamide which as a melting point of about 72° C. (162° F.) and a flash point at about 210° C. (410° F.). The amide is sold under the trademark "Armoslip CP" by Armour Industrial Chemical Company of Chicago, Ill. The strip has a dry coating weight/side of about 0.64 grams per square meter. The isopropanol solution contains 80 grams per liter of the amide. The wet film coating thickness can range between 5 μm to 2.0 (1.0 mil–0.05 mil). The strip is then passed through a curing oven to drive off the residual isopropanol with the oven being heated so as to effect a peak metal temperature of about 66° C. (150° F.). The metal temperature should not exceed 71° C. (160° F.). The strip can then be processed immediately in a Sendzimir-type hot-dip coating line or can be coiled and stored prior to hot-dip coating without adversely effecting the integrity of the amide coating or resulting in surface corrosion of the steel strip even after several months.

The strip is thereafter hot-dip coated in a Sendzimir-type hot-dip coating line by passing the strip through a furnace which burns hydrocarbon gases to heat the strip to a temperature of between about 482° C. (900° F.) and 538° C. (1000° F.). It is not necessary, however, to have an oxidizing atmosphere maintained in the furnace, since the high fatty acid amide is volatilized completely and decomposed when heated to a temperature of about 410° F. and thus serves as a protective blanket over the strip and prevents significant oxidation of the surface while in the heated furnace. Thereafter, the strip is passed through a heated furnace containing the hydrogen-nitrogen reducing atmosphere in which the strip is normally heated to a temperature of about 871° C. (1600° F.). The strip is then cooled to about 704° C. (1300° F.) while in the reducing atmosphere, and thereafter immersed in a hot-dip aluminizing bath having a temperature of about 693° C. (1280° F.). The strip is air cooled on leaving the coating bath, and thereafter coiled to provide a hot-dip aluminum coated steel strip having a continuous surface coating of aluminum devoid of uncoated spots and exhibiting high resistance against oxidation when heated in an oxygen containing atmosphere at a temperature in excess of 815° C. (1500° F.).

The term "mild steel" or "low carbon steel" as used in the present application defines a steel having a carbon content of at least 0.03% carbon and not substantially above about 0.1% carbon and is exemplified by rimmed steel and aluminum-killed steel of the type which is conventionally used for hot-dip aluminizing and hot-dip galvanizing after cold rolling.

Whereas the present invention has been illustrated by the application of hot-dip aluminum coating, it should be understood that other protective hot-dip metallic coatings can be applied in accordance with the process of the present invention, including aluminum based coating containing other alloying metals, such as magnesium, zinc and the like, and zinc coatings, zinc based alloy coatings, such as zinc-aluminum coatings and tin coatings.

I claim:

1. A process of hot-dip coating a strip of cold rolled low carbon alloy steel having as an essential alloying element at least one strong oxide forming metal which comprises; removing metallic particles and non-metallic contaminants from the surface of said strip and drying said surface, forming a uniform dry film coating of a higher fatty acid amide having a chain length of between 8 and 18 carbon atoms on the clean dry surface of said strip, heating said strip to a temperature of between about 204° C. (400° F.) and 644° C. (1200° F.) to completely volatilize the amide coating, passing said strip through a heating zone containing a reducing atmosphere in which the strip is heated to a temperature of at least about 704° C. (1300° F.), cooling said strip in a reducing atmosphere to about the temperature of a molten metal bath for hot-dip coating said strip, and passing said strip through said hot-dip coating bath.

2. A process as in claim 1, wherein said alloying element incorporated in said steel is selected from the group of strong oxide forming metals consisting of titanium, aluminum, silicon and chromium.

3. A process as in claim 1 or 2, wherein the amount of said alloying element incorporated in said steel is not significantly in excess of 5% by weight of said steel.

4. A process as in claim 1 or 2, wherein said higher fatty acid amide is selected from the group of higher fatty acid amide having a carbon chain length between 8 and 18 carbon atoms, a melting point between about 66° C. (150° F.) and 130° C. (266° F.) and volatilizing at a temperature between about 174° C. (345° F.) and 250° C. (482° F.).

5. A process as in claim 1 or 2, wherein said fatty acid amide coating has a single side dry film coating weight ranging between about 0.1 and 2.0 grams per square meter.

6. A process as in claim 1 or 2, wherein said nonmetallic contaminants on the surface of said strip are removed by washing said strip in an aqueous alkaline cleaning solution.

7. A process as in claim 6, wherein said strip is treated with a dilute aqueous acidic solution after being contacted with said aqueous alkaline cleaning solution.

8. A process as in claim 1 or 2, wherein metallic particles on the surface of said strip are removed by brushing said strip in an aqueous solution.

9. A process as in claim 1 or 2, wherein said fatty acid amide coated strip is heated to a temperature of between about 482° C. (900° F.) and 538° C. (1000° F.) to effect completely volatilizing said amide coating, and thereafter said strip is heated to a temperature of at least 704° C. (1300° F.) in a reducing atmosphere, and the said strip hot-dip coated with aluminum.

* * * * *